United States Patent [19]

Nance et al.

[11] Patent Number: 4,627,737

[45] Date of Patent: Dec. 9, 1986

[54] FULLY BI-DIRECTIONAL DIGITAL TIME DISPLAYS

[75] Inventors: Edwin P. Nance, Hong Kong, Hong Kong; Marc H. Segan, New York; Berj A. Terzian, Briarcliff Manor, both of N.Y.

[73] Assignee: Equitime, Inc., Briarcliff Manor, N.Y.

[21] Appl. No.: 734,979

[22] Filed: May 16, 1985

[51] Int. Cl.[4] ..... G04C 17/00

[52] U.S. Cl. ..... 368/239; 368/82

[58] Field of Search ..... 368/82, 239

[56] References Cited

U.S. PATENT DOCUMENTS

| | | | |
|---|---|---|---|
| 4,194,352 | 3/1980 | Terzian | 368/239 |
| 4,264,966 | 4/1981 | Terzian | 368/239 |
| 4,270,196 | 5/1981 | Terzian | 368/82 |
| 4,271,497 | 6/1981 | Terzian | 368/82 |
| 4,483,628 | 11/1984 | Terzian | 368/239 |

*Primary Examiner*—Bernard Roskoski

*Attorney, Agent, or Firm*—Lucas & Just

[57] ABSTRACT

Fully bi-directional and quantitative digital time displays are provided by displaying increasing elapsed minutes during the first half hour together with seconds increasing from zero to fifty nine during each such minute and thereafter, during the second half hour, displaying decreasing minutes remaining until the next hour together with seconds decreasing from fifty nine to zero during each such minute. The appearance and comprehendibility of the displays are enhanced by adopting thirty minutes and thirty seconds after each current hour as a predesigned point of transition from the time past to the time remaining modes, by suppressing all leading zeros, by spacing single minute digits as far as possible away from a central hours display, by suppressing zero minute displays above hockey stick-shaped underscore lines during the final minute before and after each hour, and by suppressing hockey stick and zero minute and seconds displays while displaying solely hour digits at the exact moment of completion of a current hour and commencement of the next one.

15 Claims, 13 Drawing Figures

FULLY BI-DIRECTIONAL DIGITAL TIME DISPLAYS

BACKGROUND OF THE INVENTION

1. Field of the Invention

This invention relates to digital time displays which are useful for general timekeeping. As used herein, "general timekeeping" refers to the usual timekeeping needs and practices of ordinary individuals occupied with their customary activities on a day-to-day basis, as contrasted from specialized time monitoring procedures such as stop time, split time, lap time and countdown sequences used in games, sporting events, scientific experiments, etc.

2. Description of the Prior Art

Balanced digital time displays are disclosed in U.S. Pat. Nos. 4,264,966 and 4,483,628, the disclosures of which are incorporated herein by reference. These patents describe time displays which show minutes elapsed after the current hour, typically during the first half hour, and thereafter minutes remaining before the next hour, typically during the second half of the current hour. Such displays are somewhat bi-directional in the sense that all elapsed minutes increase in value and all remaining minutes decrease in value. These progressions track the expansion phase of each hour as it increases to its peak value of thirty minutes, i.e., the midpoint, and thereafter the contraction phase as the same hour decreases to its termination, thus echoing the balanced rhythms exhibited by naturally oscillating motions, e.g., sun, moon, tides, etc., from which the perception of time, in all likelihood, first entered human consciousness.

The previous patents apply the same principle of balance to the timing of minutes by displaying increasing seconds up to a peak value of thirty, i.e., the midpoint of each minute, and thereafter decreasing seconds down to the zero value that marks the end of each minute and the start of the next one. While this achieves similar advantages of rhythm and balance in the expansion and contraction of each minute, it also introduces divergencies in the directions that minutes and seconds traverse.

In particular, when minutes are increasing during the first half of the hour, seconds proceed in the same direction only during the first half of each minute, thereafter reversing and moving in an opposite direction down to zero. Conversely, when minutes are decreasing during the second half hour, seconds initially increase in an opposite direction during the first half minute, and then reverse and move in the same direction toward zero.

These divergencies may well impact negatively on some viewers as being anomalous, inconsistent or confusing. They also preclude the attainment of important advantages of full bi-directionality during the course of each hour and minute.

SUMMARY OF THE INVENTION

The present invention eliminates the above-described divergencies and provides fully bi-directional digital time displays which avoid potential problems that may be caused by anomalous, inconsistent or confusing displays. More particularly, in the displays of the present invention, whenever minutes are increasing, typically during the first half of each hour, seconds are shown to increase from one to fifty nine with resetting to zero as each such minute ends and the next one begins. Conversely, whenever minutes are decreasing, typically during the second half hour, seconds are shown to decrease from fifty nine to zero during each of those minutes.

Such displays are fully bi-directional since, without exception, minutes and seconds always stay in phase by moving together in the same direction, either up or down. As a result, every pair of minute/second values can be understood as either growth of total elapsed time or diminution of total remaining time, measured on a scale that resolves down to one second as its smallest interval.

This comprehendibility becomes possible because the viewer knows, for example, from the mere fact that elapsed minutes are on display that seconds will always increase over the full fifty nine seconds cycle during each of those minutes. Therefore, the minute/second value pairs seen during the first half hour period will consistently indicate the progressively enlarging time interval by which the display is moving away from the start of the current hour during that period, both in minutes and the fractional parts of each minute defined by the constantly increasing seconds.

Likewise, from the mere fact that remaining minutes are on display during the second half hour, the viewer knows that seconds will always move down in the fifty nine to zero sequence during each of those minutes. This means that the minute/seconds value pairs seen during that period will invariably specify the progressively diminishing time interval by which the display is approaching the next hour, again both in minutes and the fractional parts of each minute measured by the constantly decreasing seconds.

Thus, because the displays of this invention are fully bi-directional, they are also completely quantitive. Every pair of displayed minutes and seconds unambiguously informs the viewer of the exact number of minutes and seconds that have either elapsed since the start of the current hour or remain until the start of the next hour. In effect, then, such minute/seconds values act as ordinal numbers that measure order and rank of progression away from and back toward fixed, centrally located cardinal numbers that uniquely define and identify each hour.

These advantages also translate into faster reading displays in the present invention compared to the previous patents. In the previous displays, since each value of seconds was shown twice during each minute, once during the count up to thirty and again during the countdown back to zero, it was necessary to observe two consecutive values to understand the time significance of any one specific seconds value (other than zero and thirty). This delay is eliminated in the present invention, since each value of seconds is unique and never repeated during the period of each minute (except during one midpoint transition), whether the seconds are counting up or down. Coupled with the fact that the type of displayed minute, either elapsed or remaining, is what informs the viewer whether seconds are counting up or down, each displayed value pair of minutes and seconds in the displays of the present invention may be instantly read and understood without having to relate such values to others that have preceded or will follow, as in the previous patents.

In addition to the above advantages, further improvements are made in the displays of the present invention by introducing the principles of division in half and balance during a transition from elapsed to remaining time at a predesigned, although not the technically precise, midpoint of each hour, elimination of all leading zeros, positioning of single digit minute values in symmetrical positions spaced farthest from and flanking a central hour display, elimination of zero minute values above hockey stick-shaped underscore lines during the final minute before and after each hour, and suppression of hockey stick and zero minute and seconds displays while displaying solely hour digits at the exact moment of completion of the current hour and the corresponding start of the next one, all of which details will be readily understood from the following description of a preferred embodiment of the invention taken in connection with the drawings.

DESCRIPTION OF THE PREFERRED EMBODIMENT

Figure 1:
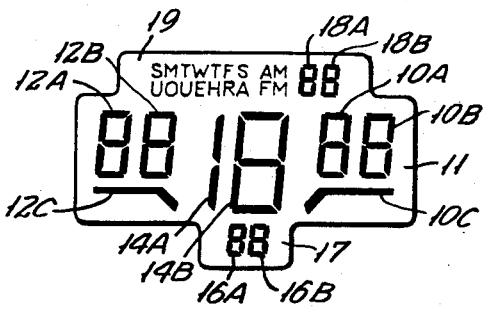
FIG. 1 is a front view of digital display elements arranged for use in accordance with a preferred embodiment of this invention.

Referring to FIG. 1, there is illustrated a layout of energizable display elements that is similar to the arrangement shown in U.S. Pat. No. 4,483,628. Briefly, the double eight elements 10A, 10B in the middle display field 11, underscored by the upwardly sloping hockey stick-shaped line 10C, are used for display of elapsed minutes after the start of a current hour. Conversely, the double eight elements 12A, 12B, underscored by the downwardly sloping hockey stick line 12C, are used to display minutes remaining before the commencement of the next hour.

The large elements 14A, 14B at the center of the middle display field are used to display hour values ranging from one to twelve. The double eight elements 16A, 16B in the bottom display field 17 are used to display values of seconds ranging from zero to fifty nine for each minute during the first half of a current hour, and from fifty nine to zero for each minute during the second half of that hour.

The double eight elements 18A, 18B in the top display field 19 are used to display the date of the month. The AM/PM elements in the same field are used only during setting to synchronize a time setting to the correct forenoon or afternoon cycle. The vertically oriented two-letter abbreviations "SU" to "SA" are used to separately display each day of the week and thus portray the progress of each week's period across the top display field. The size, shape and positions of the top 19, middle 11 and bottom 17 display fields visually distinguish each one from the others.

Figure 13:
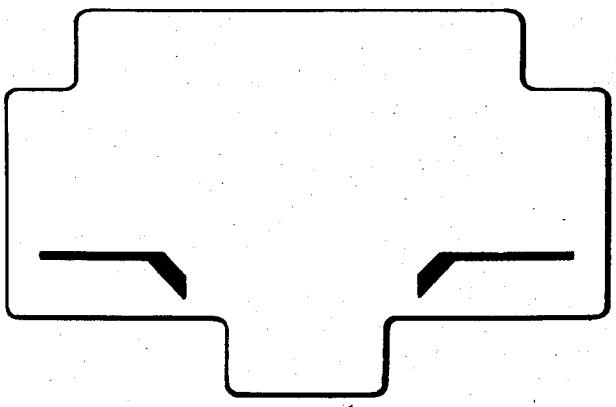
FIG. 13 illustrates on an enlarged scale the relative dimensions of the hockey stick underscore lines shown in FIGS. 1–12.

The FIG. 1 arrangement uses two-letter abbreviations to display the days of the week, in contrast to the three-letter abbreviations disclosed in the previously cited patents. The two-letter abbreviations are sufficient to unambiguously name each day, conserve space and help to achieve economy of design. The FIG. 1 arrangement also differs from the previous patent in that the horizontal handle portions of the hockey stick underscore lines are thinner, preferably by about one-half, than the thickness of the sloping blade portions, as illustrated in FIG. 13. This serves to emphasize the most significant messages provided by these elements, that is, an upwardly sloping blade portion indicates that elapsed minutes are on display, whereas a downwardly sloping blade portion signifies the converse, that remaining minutes before the next hour are on display, reading the sticks from left to right in both cases.

Figure 2:
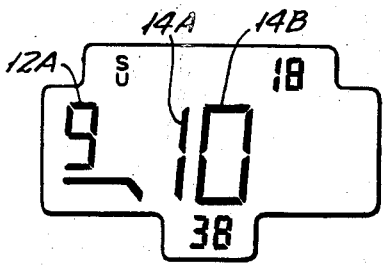
FIGS. 2–6 show the FIG. 1 embodiment in representative time displays within the last ten minutes before the completion of a current hour.

Referring now to FIG. 2, there is illustrated a time display of nine minutes and thirty eight seconds remaining before the next hour, ten-o-clock, on a Sunday dated the eighteenth of the month. Such value of minutes is displayed with a single digit by elements 12A at the most widely spaced position to the left of the hour elements 14A, 14B. For this purpose, a leading zero digit before the minute digit nine is suppressed at this time and throughout the remaining time before commencement of the next hour.

The use of single minute digits shifted to the left in this manner provides several advantages. It shows a reduction in the amount of space occupied to the left of the hour display, as contrasted from the greater filling of that space by the previous double digit minute values, and thus visually portrays the smaller and diminishing nine minute period remaining before the end of the current hour. It eliminates the surplusage of a leading zero digit, which adds nothing to the information provided by the single nine digit and which, if included, would require time to be read and understood in the viewer's mind as meaning nothing. Also, by increasing the spacing between the minute and hour digits, it improves the distinction between and the comprehendibility of these different items of information.

Figure 3:
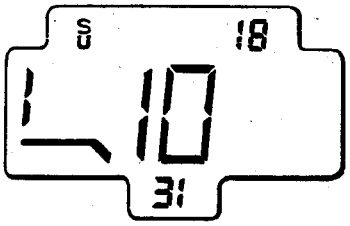
Figure 4:
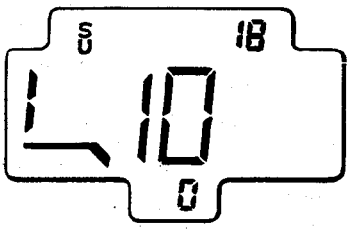

FIG. 3 illustrates the time display at one minute and thirty one seconds remaining before the tenth hour, and FIG. 4 shows the appearance of the display exactly thirty one seconds later when the point is reached of one final minute remaining before that hour, as signified by the single minute digit one and the single zero seconds digit below the hour. Again, by shifting the single minute digit as much as possible to the left, even greater reduction is achieved in the amount of occupied space reserved for remaining minutes, as well as greater spacing between the minute and hour values, to emphasize the small interval left before the end of the current hour and the commencement of the next hour.

Figure 5:
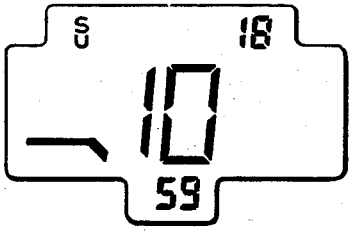

FIG. 5 shows the display exactly one second after the time displayed in FIG. 4, when the countdown of the last remaining fifty nine seconds to the next hour begins. To further signal this important period, the minute elements 12A, 12B are totally blanked, which suppresses a zero minute value at the moment when none, in fact, is left and a showing of zero would be superfluous. Thus, beginning with the countdown of less than one minute before the next hour, as illustrated in FIG. 5, the hockey stick line 12C alone is used to guide the viewer's eye to the seconds digits below where the only remaining time information is on display, i.e., the narrowing seconds before the current hour's conclusion and the next one's start.

Figure 6:
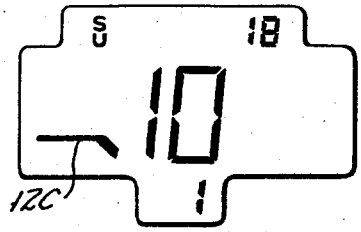

This countdown sequence continues until the last remaining second before completion of the current hour and commencement of the next one, which is illustrated in FIG. 6. At that point, the viewer is informed by the left hockey stick 12C that he is still approaching the next hour, and the unit seconds digit below the hour digits specifies that only one full second remains before that next hour's beginning.

Figure 7:
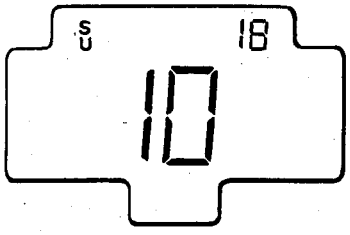
FIG. 7 shows the FIG. 1 embodiment at exactly the completion of the current hour and the simultaneous commencement of a next hour.

FIG. 7 illustrates the appearance of the display at that next transition. The left hockey stick goes blank, and a zero seconds digit below the hour digit is suppressed as superfluous. Thus, all that the viewer sees is the hour digit in the center for the period of one second. This is a unique display seen only at the exact completion of each hour, which singles out each of the successive hour digits for special treatment to emphasize the cardinal nature of such digits and the fact that when seen alone, one is no longer either approaching or departing from these special moments in time; one is there precisely.

Figure 8:
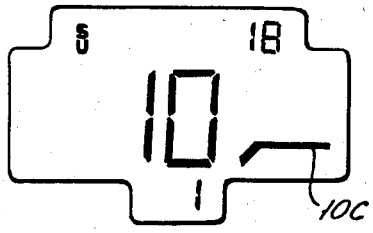
FIGS. 8–10 show the FIG. 1 embodiment in representative time displays within the first ten minutes after the commencement of that next hour.

FIG. 8 illustrates the display at exactly one elapsed second after FIG. 7. A zero minute digit is again suppressed above the hockey stick line 10C as superfluous. Therefore, the eye is once again directed to the seconds digits below the hour for a display of the fractional parts of the first minute that are elapsing. This is the elapsed time complement of the remaining time display illustrated in FIG. 6.

Figure 9:
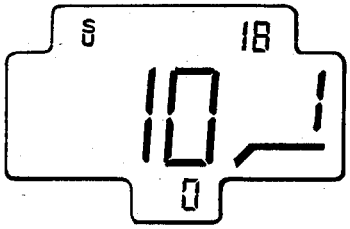

FIG. 9 shows the display exactly after the first full minute has elapsed after the tenth hour. Again, a leading zero minute digit is suppressed and the single minute digit one is positioned as far to the right of the hours display as possible. This is the complement of the information given by the FIG. 4 display and the two displays correspondingly are symmetrical images of each other.

Figure 10:
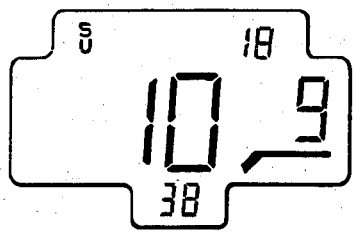

Similarly, FIG. 10 shows the display at nine minutes and thirty eight seconds after the current hour, which is the complement and symmetrical image of the FIG. 2 display. Suppression of all leading zeros during the entire nine minute period after commencement of the new hour results in gradual filling of the space reserved for display of elapsed minutes, which gives visual indication of the growing length of time by which the time display is moving away from the start of the hour. This again is the complement and symmetrical image of the gradually shrinking occupied space to the left of the hours illustrated in FIGS. 2–4.

Figure 11:
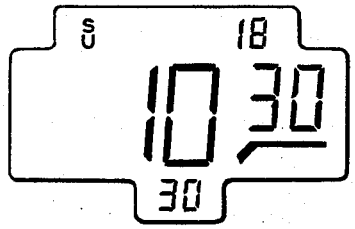
FIGS. 11 and 12 the FIG. 1 embodiment switching from elapsed time to remaining time before the next hour at a predesigned midpoint of the current hour.
Figure 12:
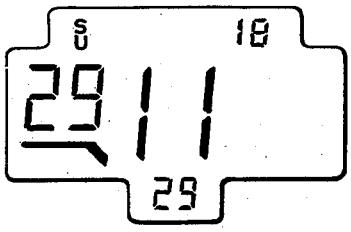

FIG. 11 shows the display at thirty minutes and thirty seconds after the start of the tenth hour. This is a predesigned midpoint at which the display is caused to switch from elapsed time to remaining time before the next hour.

Technically, the exact midpoint of the hour is thirty minutes and zero seconds after its commencement, which is thirty seconds earlier than the time displayed in FIG. 11. However, if the display were to switch to remaining time at the technical midpoint, several problems would arise. First, in the period of two seconds, three different values of minutes would be seen as the display would progress from ten twenty nine and fifty nine seconds to ten thirty and zero seconds, and then to twenty nine minutes and fifty nine seconds to eleven. Moreover, half past the hour is an important benchmark in general timekeeping, but it would be seen for only the fleeting period of one second, which would detract from the utility and appeal of the system to most viewers.

On the other hand, if the transition from elapsed to remaining time were delayed until fifty nine seconds after half past the hour, to make it coincide with the next subsequent minute mark, similar problems would be encountered. In the space of two seconds, three different minute values would be seen as the display would shift from ten thirty and fifty nine seconds to twenty nine minutes and zero seconds and then twenty eight minutes and fifty nine seconds before eleven. And again, the very first remaining minutes value displayed before the next hour, twenty nine, would be seen for only one second.

To avoid all of these difficulties, the display is switched from the elapsed to the remaining time mode at the predesigned midpoint shown in FIG. 11. Technically, this splits the thirty first minute after the hour exactly in half Thus, one second thereafter the hour advances to the next hour, minutes shift to the left side above the downwardly sloping hockey stick and step down from value thirty to value twenty nine, and seconds likewise step down in value from thirty to twenty nine.

This accomplishes the smoothest and most balanced transition from the elapsed to the remaining time mode. All digit values change by a magnitude of one, and minutes and seconds undergo an identical phase shift from incrementing to decrementing. Moreover, the two counterparts of the transition, on one side elapsed time and on the other remaining time, are both displayed for equal half-minute periods which are precisely tracked by the up/down count of seconds from zero to thirty and back down to zero during the thirty first minute. Consequently, this single up/down count sequence serves as a unique indicator of the important moment when the display shifts its view from looking backward to looking forward in time.

A specific implementation of the above preferred embodiment has been carried out by programming a microprocessor integrated circuit sold by Oki Electric Industry Co., Ltd. of Tokyo, Japan under the trade designation P/N MSM5054. This IC was connected to a liquid crystal display containing the display element layout of FIG. 1 and battery power to manufacture wrist watches showing fully bi-directional time displays in accordance with this invention.

The principles of the invention have now been described, together with a complete preferred embodiment thereof. The invention obviously may be implemented with other energizable display elements such as incandescent, electroluminiscent and fluorescent lamps, or light emitting diodes, as well as other integrated circuits or hardware with suitable software, if necessary, to operate the display elements in accordance with the principles of the invention. Other obvious variations can be made, such as elimination of the day and/or date display if such information is not desired. Different relative sizes or proportions of digit display elements than those shown in the illustrative drawings may be used, although for maximum comprehendability it is recommended that hours be the largest, minutes intermediate and seconds the smallest in overall size, in conformity with the magnitudes of time represented by these respective numbers. The hockey stick underscore lines may be flashed at half second on/half second off intervals during the minute before and/or after each new hour, or during shorter fractions of one or both such periods, to give added signal of these important timing benchmarks of imminent completion of a current hour and commencement of the next one. The auxiliary chronographic timekeeping display elements disclosed in U.S. Pat. No. 4,483,628 may be added to the display arrangement illustrated in FIG. 1, together with conventional logic to operate the display as a combination general timekeeping and chronographic timepiece.

Accordingly, it will be understood that the invention is not limited to the preferred illustrative embodiment but also encompasses the subject matter delineated by the following claims and all equivalents thereof.

What is claimed:

1. Fully bi-directional digital time displays which comprise:

(a) hour elements operable for display of current or next hour digits during the same hour;

(b) first minute elements operable for display of minute digits in a position to the right of a displayed current hour;

(c) second minute elements operable for display of minute digits in a position to the left of a displayed next hour;

(d) seconds elements operable to display either increasing or decreasing seconds;

(e) means for operating the first minute elements (b) to display increasing values of minutes from none to thirty while a current hour is on display and for operating the seconds elements (d) to display increasing values of seconds from zero to fifty nine during the period of each such minute except after thirty elapsed minutes;

(f) means for operating the second minute elements (c) to display decreasing values of minutes from twenty nine to none while a next hour is on display and for operating the seconds elements (d) to display decreasing values of seconds from fifty nine to zero during the period of each such minute except before twenty nine remaining minutes; and (g) means for displaying zero to about thirty seconds while the first minute elements (b) are displaying thirty minutes, then switching the display at the next second by blanking the first minute elements (b) and advancing the hour digit (a) to the next hour, and displaying about twenty nine to zero seconds while the second minute elements (c) are displaying twenty nine minutes.

2. Displays in accordance with claim 1 which further comprise:

(h) a first hockey stick-shaped display element operable to display a hockey stick-shaped line below the first minute elements (b), the short segment of such line being oriented to slope upwardly and away from current hour digits followed by the longer segment thereof in a left to right direction;

(i) a second hockey stick-shaped display element operable to display a hockey stick-shaped line below the second minute elements (c), the short segment of such line being oriented to slope downwardly and toward next hour digits preceded by the longer segment thereof in a left to right direction;

(j) means for operating the first hockey stick-shaped element (h) to display the corresponding line thereof during the time that the first minute elements (b) are displaying increasing minute values; and (k) means for operating the second hockey stick-shaped element (i) to display the corresponding line thereof during the time that the second minute elements (c) are displaying decreasing minute values.

3. Displays in accordance with claim 1 wherein all leading zero digits before all displayed minute and seconds values are blanked.

4. Displays in accordance with claim 3 wherein all single digit minute values are displayed in positions spaced to the right and left away from the hour digits as far as permitted by the first and second minute elements (b) and (c).

5. Displays in accordance with claim 2 wherein said first hockey stick-shaped element (g) is operated to show the corresponding line thereof with no minute value above it during the period that the seconds elements (d) are displaying the first fifty nine seconds after a current hour, and wherein said second hockey stick-shaped element (h) element is operated to show the corresponding line thereof with no minute value above it during the period that the seconds elements (d) are displaying the final fifty nine seconds before a next hour.

6. Displays in accordance with claim 5 wherein at the exact moment of completion of a previous hour and commencement of a new hour both hockey stick-shaped elements (h) and (i), both minute elements (b) and (c), and the seconds elements (d) are blanked to display the hour digits (g) alone to mark that moment.

7. Displays in accordance with claim 5 wherein said first hockey stick-shaped line (h) is flashed on and off during all or part of the first fifty nine seconds after commencement of a current hour.

8. Displays in accordance with claim 5 wherein said second hockey stick-shaped line (i) is flashed on and off during all or part of the final fifty nine seconds before commencement of a next hour.

9. Displays in accordance with claim 2 wherein the longer segments of the first and second hockey stick-shaped elements (h) and (i) are thinner than the sloping short segments thereof.

10. Displays in accordance with claim 7 wherein the longer segments are about one-half the thickness of the sloping short segments.

11. Displays in accordance with claim 1 wherein the hour elements (a) and the first and second minute elements (b) and (c) are positioned in a first relatively large display field and wherein the seconds elements (d) are positioned in a second relatively small display field centered below the hour elements (a).

12. Displays in accordance with claim 11 which further include a third display field intermediate in size to the first and second display fields and positioned above the first display field, the third field containing display elements operable to display abbreviations of the days of the week and further containing display elements operable to display the date of each day, means for operating the abbreviated day-of-week display elements to show each day separately from the others, and means for operating the date elements to show the date of each separated displayed day.

13. Displays in accordance with claim 12 wherein the day-of-week elements are two-letter abbreviations positioned to the left of the date display elements, arranged in "SU" to "SA" left to right order and are separately displayed in that order.

14. Displays in accordance with claim 13 wherein the letters of each two-letter abbreviation are vertically positioned one over the other and displayed in that position.

15. Displays in accordance with claim 1 wherein the hour elements (a) are the largest, the first and second minute elements (b) and (c) are equal and intermediate, and the seconds elements (d) are the smallest, in overall size.

* * * * *

UNITED STATES PATENT AND TRADEMARK OFFICE

CERTIFICATE OF CORRECTION

PATENT NO. : 4,627,737

DATED : December 9, 1986

INVENTOR(S) : Edwin P. Nance et al.

It is certified that error appears in the above-identified patent and that said Letters Patent is hereby corrected as shown below:

Column 3, line 30, after "12" insert --show--.

Column 8, claim 10, line 1, change the dependency from "claim 7" to --claim 9--.

Signed and Sealed this

Seventh Day of April, 1987

*Attest:*

DONALD J. QUIGG

*Attesting Officer*

*Commissioner of Patents and Trademarks*